US011772374B2

(12) United States Patent
Stierman et al.

(10) Patent No.: US 11,772,374 B2
(45) Date of Patent: Oct. 3, 2023

(54) PRINTING PRESS WITH IN-LINE CASTING DEVICE FOR THE REPLICATION AND FORMATION OF A MICRO-OPTICAL STRUCTURE

(71) Applicant: KBA-NOTASYS SA, Lausanne (CH)

(72) Inventors: Robert Stierman, Alphen aan den Rijn (NL); Ana Dimitrijevic, Lausanne (CH); Martin Palme, Kist (DE); Thomas Kersten, Chernex (CH); Aurélie Berthon, Villars-sous-Yens (CH)

(73) Assignee: KBA-NOTASYS SA, Lausanne (CH)

( * ) Notice: Subject to any disclaimer, the term of this patent is extended or adjusted under 35 U.S.C. 154(b) by 127 days.

(21) Appl. No.: 16/488,124

(22) PCT Filed: Feb. 20, 2018

(86) PCT No.: PCT/EP2018/054103

§ 371 (c)(1),
(2) Date: Aug. 22, 2019

(87) PCT Pub. No.: WO2018/153839

PCT Pub. Date: Aug. 30, 2018

(65) Prior Publication Data

US 2019/0381785 A1 Dec. 19, 2019

(30) Foreign Application Priority Data

Feb. 22, 2017 (EP) ..... 17157503
Apr. 24, 2017 (EP) ..... 17167792

(51) Int. Cl.
*B41F 15/08* (2006.01)
*B41F 11/02* (2006.01)
(Continued)

(52) U.S. Cl.
CPC ..... *B41F 15/0809* (2013.01); *B41F 11/02* (2013.01); *B41F 15/0836* (2013.01);
(Continued)

(58) Field of Classification Search
CPC ..... B41F 19/02; B41F 9/005; B41F 9/006; B41F 9/026; B41F 9/025; B41F 9/002;
(Continued)

(56) References Cited

U.S. PATENT DOCUMENTS 3,664,261 A * 5/1972 Dahlgren ..... B41F 7/12 101/177
8,499,690 B2 * 8/2013 Schwitzky ..... B41F 9/021 101/152

(Continued)

FOREIGN PATENT DOCUMENTS

EP 0 723 864 7/1996
EP 0 949 069 10/1999

(Continued)

OTHER PUBLICATIONS

Office Action issued in U.S. Appl. No. 16/488,044 (13 pages).

(Continued)

*Primary Examiner* — Jennifer Bahls
*Assistant Examiner* — Quang X Nguyen
(74) *Attorney, Agent, or Firm* — Nixon & Vanderhye P.C.

(57) ABSTRACT

There is described a printing press adapted to carry out printing on a sheet-like or web-like substrate, in particular for the production of security documents such as banknotes, comprising a substrate feeding device for feeding the substrate to be treated, at least a printing unit designed to print a first side and/or a second side of the substrate and a delivery unit for receiving the treated substrate. The printing press in the conveying path for the substrate between the feeding device and the delivery unit further comprises an (Continued)

in-line casting device adapted to apply a layer of material acting as an optical medium on a portion of the second side of the substrate and to replicate and form a micro-optical structure in the layer of material acting as optical medium, wherein the printing unit comprises a first printing group comprising a printing cylinder and being adapted to print at least one printed pattern on the first or second side of the substrate in register with the micro-optical structure.

27 Claims, 6 Drawing Sheets

(51) Int. Cl.

| | |
|---|---|
| ***B41F 19/00*** | (2006.01) |
| ***B41F 19/02*** | (2006.01) |
| ***B41M 1/24*** | (2006.01) |
| *B42D 25/324* | (2014.01) |
| *B41F 3/54* | (2006.01) |
| *B41F 21/08* | (2006.01) |

(52) U.S. Cl.
CPC ..... *B41F 19/002* (2013.01); *B41F 19/02* (2013.01); *B41M 1/24* (2013.01); *B41F 3/54* (2013.01); *B41F 21/08* (2013.01); *B41P 2200/13* (2013.01); *B42D 25/324* (2014.10)

(58) Field of Classification Search
CPC .. B41F 9/01; B41F 9/021; B41F 11/02; B41F 7/12; B41F 15/0809; B41F 15/0836; B41F 3/54; B41F 21/08; B41M 1/24; B42D 25/324
See application file for complete search history.

(56) References Cited

U.S. PATENT DOCUMENTS

| | | | | |
|---|---|---|---|---|
| 2002/0189474 | A1* | 12/2002 | Biagiotti | B41F 35/02 101/425 |
| 2006/0275669 | A1* | 12/2006 | Casitas | G03H 1/0236 430/1 |
| 2008/0024846 | A1 | 1/2008 | Tompkin et al. | |
| 2008/0271620 | A1* | 11/2008 | Hoier | B41F 11/02 101/216 |
| 2011/0205282 | A1* | 8/2011 | Houjou | B41J 11/00 347/16 |
| 2014/0096694 | A1* | 4/2014 | DeMoore | B41F 35/006 101/232 |
| 2015/0146297 | A1 | 5/2015 | Commander | |
| 2015/0158323 | A1* | 6/2015 | Richert | C09D 7/61 283/85 |
| 2015/0360453 | A1* | 12/2015 | Lundvall | B41M 1/10 156/240 |
| 2016/0200088 | A1* | 7/2016 | Schaede | B32B 38/04 156/108 |
| 2016/0339653 | A1* | 11/2016 | Berthon | B42D 25/29 |

FOREIGN PATENT DOCUMENTS

| | | | |
|---|---|---|---|
| EP | 1 842 665 | | 10/2007 |
| EP | 1 878 584 | | 1/2008 |
| EP | 3 017 946 | | 5/2016 |
| JP | 2001-187442 | A | 7/2001 |
| JP | 2007-090670 | | 4/2007 |
| JP | 2007-515311 | | 6/2007 |
| JP | 2009-511304 | | 3/2009 |
| JP | 2013-184449 | A | 9/2013 |
| JP | 2016-510700 | A | 4/2016 |
| JP | 2016-536169 | | 11/2016 |
| WO | 94/27254 | | 11/1994 |
| WO | 2005/051675 | | 6/2005 |
| WO | 2007/020048 | | 2/2007 |
| WO | 2007/042919 | | 4/2007 |
| WO | 2007/105059 | | 9/2007 |
| WO | 2007/105061 | | 9/2007 |
| WO | 2008/099330 | | 8/2008 |
| WO | 2011/145028 | | 11/2011 |
| WO | 2013/001009 | | 1/2013 |
| WO | 2013/001010 | | 1/2013 |
| WO | 2013/001518 | | 1/2013 |
| WO | 2014/039476 | | 3/2014 |
| WO | 2014/085290 | | 6/2014 |
| WO | 2014/125454 | | 8/2014 |
| WO | 2014/136092 | A1 | 9/2014 |
| WO | 2015/022612 | | 2/2015 |
| WO | 2015/107488 | | 7/2015 |
| WO | 2016/038572 | | 3/2016 |
| WO | 2016/071870 | | 5/2016 |

OTHER PUBLICATIONS

Office Action dated Feb. 4, 2020 issued in Japanese Application No. 2019-544699 (5 pages).
Office Action dated Jun. 16, 2020 issued in Japanese Applicatin No. 2019-544048 with English translation (10 pages).
International Search Report for PCT/EP2018/054103 dated Apr. 17, 2018, 3 pages.

* cited by examiner

PRINTING PRESS WITH IN-LINE CASTING DEVICE FOR THE REPLICATION AND FORMATION OF A MICRO-OPTICAL STRUCTURE

This application is the U.S. national phase of International Application No. PCT/EP2018/054103 filed Feb. 20, 2018 which designated the U.S. and claims priority to EP 17157503.8 filed Feb. 22, 2017, and EP 17167792.5 filed Apr. 24, 2017, the entire contents of which are hereby incorporated by reference.

TECHNICAL FIELD

The present invention generally relates to a printing press—especially an offset printing press—adapted to carry out printing on a sheet-like or web-like substrate, in particular for the production of security documents such as banknotes, comprising a printing unit designed to print a first side and/or a second side of the substrate. The invention especially relates to a printing press preferably comprising a printing unit with at least a printing group designed to print a first side and/or a second side of the substrate by collecting different impressions respectively ink patterns in their respective colours on a cylinder, e.g. a collecting cylinder, in advance before being printed onto the substrate.

BACKGROUND OF THE INVENTION

Offset printing presses for the production of security documents such as banknotes are known as such in the art, in particular from European Patent Publication No. EP 0 949 069 A1 and International PCT Publications Nos. WO 2007/042919 A2, WO 2007/105059 A1, WO 2007/105061 A1, WO 2008/099330 A2 and WO 2016/071870 A1, which publications are all incorporated herein by reference in their entirety.

International PCT Publication No. WO 2007/042919 A2 in particular discloses a recto-verso offset printing press adapted for simultaneous recto-verso printing of sheets that further comprises an additional printing group placed upstream of a main printing group of the printing press.

FIGS. 1 and 2 illustrate such a recto-verso printing press that is adapted to carry out simultaneous recto-verso printing of sheets, as typically used for the production of banknotes and like security documents, which printing press is designated globally by reference numeral 100. Such printing press is in particular marketed by the present Applicant under the product designation Super Simultan® IV. The basic configuration of the printing press 100 shown in FIGS. 1 and 2 is similar to that shown and discussed with reference to FIG. 1 of International PCT Publication No. WO 2007/042919 A2.

This printing press 100 comprises a printing unit 2, which is specifically adapted to perform simultaneous recto-verso printing of the sheets (according to the so-called Simultan-offset printing principle) and comprises, as is typical in the art, two blanket cylinders (or printing cylinders) 5, 6 rotating in the direction indicated by the arrows and between which the sheets are fed to receive multicolour impressions. In this example, blanket cylinders 5, 6 are three-segment cylinders which are supported between a pair of side frames designated by reference numeral 20. The blanket cylinders 5, 6 receive and collect different ink patterns in their respective colours from plate cylinders 15 and 16 (four on each side) which are distributed around a portion of the circumference of the blanket cylinders 5, 6. These plate cylinders 15 and 16, which each carry a corresponding printing plate, are themselves inked by corresponding inking apparatuses 25 and 26, respectively. The plate cylinder 15, 16 together with the associated inking apparatus 25, 26 hereby form a kind of colour separation delivery branch, delivering the respective separation for collecting on the respective blanket cylinder 5, 6. The two groups of inking apparatuses 25, 26 are advantageously supported in two inking carriages 21, 22 that can be moved toward or away from the centrally-located plate cylinders 15, 16 and blanket cylinders 5, 6.

As is known in the art, each printing plate is wrapped around the corresponding plate cylinder 15, 16 and clamped at its leading end and trailing end by a suitable plate clamping system, which plate clamping system is located in a corresponding cylinder pit of the plate cylinder (see e.g. International (PCT) Publications Nos. WO 2013/001518 A1, WO 2013/001009 A1 and WO 2013/001010 A2, which are also incorporated herein by reference in their entirety).

Sheets are fed from a substrate delivery unit 1, e.g. sheet feeder 1 onto a feeder table 1* located next to the printing unit 2 (on the right-hand side in FIGS. 1 and 2) to a succession of transfer cylinders 9, 8', 10 (three cylinders in this example) placed upstream of the blanket cylinders 5, 6. While being transported by the transfer cylinder 8', the sheets receive a first impression on one side of the sheets using an additional printing group, the transfer cylinder 8' fulfilling the additional function of impression cylinder. This additional printing group consists of, in addition to the transfer cylinder 8', a blanket cylinder 8 (a two-segment cylinder in this example) that collects inks from two plate cylinders 18 that are inked by corresponding inking apparatuses 28. The inking apparatuses 28 are advantageously supported in an inking carriage 24 that can be moved toward or away from the plate cylinders 18 and blanket cylinder 8. The sheets that are printed by means of the additional printing group are first dried/cured by a drying/curing unit (designated by reference numeral 50 in FIG. 2) while being transported by the sheet transfer cylinder 8' before being transferred to the downstream-located main printing group.

In the example of FIGS. 1 and 2, the sheets are transferred onto the surface of blanket cylinder 5 where a leading edge of each sheet is held by appropriate gripper means located in cylinder pits between each segment of the blanket cylinder 5. Each sheet is thus transported by the blanket cylinder 5 to the printing nip between the blanket cylinders 5 and 6 where simultaneous recto-verso printing occurs. Once printed on both sides, the printed sheets are then transferred, as known in the art, to a sheet conveying system 3 (such as a chain gripper system with spaced-apart gripper bars) for delivery in a substrate delivery unit 4, e.g. sheet delivery unit 4, comprising multiple (e.g. three) delivery pile units. Reference numeral 31 in FIG. 2 designates a pair of chain wheels located at the upstream end of the sheet conveying system 3.

In the example of FIGS. 1 and 2, first and second transfer cylinders or drums 11, 12, such as suction drums or cylinders, are interposed between the sheet conveying system 3 and the blanket cylinder 5. These first and second transfer cylinders 11, 12 are optional (and could therefore be omitted) and are designed to carry out inspection of the sheets on the recto and verso sides as described for instance in International application No. WO 2007/105059 A1. Reference numerals 61, 62 in FIG. 2 designate corresponding inspection cameras (such as line-scan cameras) that cooperate with cylinder or drums 11, 12.

The printing press of FIGS. 1 and 2 is especially used for the purpose of printing multicolour patterns with a very high colour-to-colour register. Such multicolour patterns can in particular be combined with a micro-optical structure (such as a micro-lens structure) to create optically-variable effects as for instance disclosed in International Publications Nos. WO 2007/020048 A2, WO 2014/039476 A1 and WO 2014/085290 A1, which publications are incorporated herein by reference.

The relevant micro-optical structures are typically applied in a separate and dedicated process, in particular in combination with transparent windows that are formed in the substrate material, whether prior to or during the formation of the relevant micro-optical structures. Known processes for creating such micro-optical structures are disclosed for instance in European Patent Publication No. EP 1 878 584 A2 and International Publications Nos. WO 94/27254 A1, WO 2007/020048 A2, WO 2014/125454 A1, WO 2015/022612 A1 and WO 2015/107488 A1, which publications are likewise incorporated herein by reference.

The WO 2015/022612 A1 more precisely discloses a substrate with a window region filled with transparent polymer material and with a micro-optical structure covering the filling on one side of the window region. Furthermore there are disclosed two alternative methods and a device to create such an substrate. Such provided substrate as part of the production of security can be printed on the side opposing the micro-optical structure.

Application of a separate and dedicated process to create the necessary micro-optical structures is however cumbersome and adds up to the complexity and cost of the production of the relevant security features and documents incorporating the same. There is therefore a need for an improved solution, especially such a solution that streamlines and simplifies the production of documents that are to be provided with security elements incorporating micro-optical structures.

SUMMARY OF THE INVENTION

A general aim of the invention is to improve the known printing presses of the aforementioned type.

More precisely, an aim of the present invention is to provide such a printing press that allows to achieve high register between micro-optical structures to be provided on the substrate material and the printed patterns to be printed in combination with such micro-optical structures.

Another aim of the present invention is to provide such a printing press where machine operability and accessibility are not compromised.

These aims are achieved thanks to the printing press defined in the claims. In particular there is provided a printing press adapted to carry out printing on a sheet-like or web-like substrate, in particular for the production of security documents such as banknotes, comprising a printing unit designed to print a first side and/or a second side of the substrate in register with an inline applied optical structure, the printing press preferably comprising a printing unit with at least a printing group designed to print a first side and/or a second side of the substrate by collecting different ink patterns in their respective colours and/or several impressions from several plate cylinders on a cylinder, e.g. collecting cylinder, in advance before being printed as a whole onto the substrate. Such printing group further shortly is named as impressions collecting group or, as further cited, collect printing group.

Instead or preferably in addition to the above, in a preferred embodiment the printing group is designed as printing group for indirect printing, such as indirect lithographic printing, i.e. offset printing, or an indirect relief printing, e.g. letterset printing, or a combination with both of them.

The printing unit or especially the collect printing group preferably can be configured with at least one or more inking apparatuses and associated plate cylinders designed to enable and/or carry out offset printing, comprising for example a dampening system and/or at least the possibility to place lithographic printing plates onto the respective plate cylinder. Although these inking apparatuses possibly can also be run for letterset printing without or with inactive dampening system and with a letterpress printing plate, the printing group or printing unit nevertheless is designed—at least partly—as an offset printing group respectively printing unit. In addition to plate cylinders and inking apparatuses designed to enable and/or carry out offset printing a collect printing group or unit can comprise additional plate cylinders with associated inking apparatuses designed to especially carry out only other kinds of printing, for example letterset printing. In this sense, the above collect printing unit or group shall be understood as an offset printing unit or group, provided at least one, more or all of its plate cylinders and corresponding inking apparatuses is or are designed to enable and/or carry out offset printing.

In an alternative embodiment, the printing unit or especially the collect printing group can be configured only with one or more plate cylinders and associated inking apparatuses designed to enable and/or carry out indirect relief printing, e.g. such as letterset printing.

According to the invention, the printing press further comprises an in-line casting device adapted to apply a layer of material acting as an optical medium on a portion of the first or second side of the substrate and to replicate and form a micro-optical structure in the layer of material acting as optical medium. Furthermore, the printing unit is adapted to print at least one printed pattern on the first or second side of the substrate in register with the micro-optical structure. The term "first" side and "second" side for the sides of the substrates are arbitrarily chosen and can be inverted.

In accordance with a preferred embodiment of the invention, the in-line casting device comprises at least one application unit, e.g. a screen-printing unit acting as application unit, for applying at least a part of the layer of material acting as optical medium. In the context of the present invention, more than one application unit, e.g. screen-printing unit, could be provided, especially if the quantity of material acting as the optical medium is to be increased. Other processes than screen printing could furthermore be contemplated to apply the relevant material acting as optical medium, it being however to be appreciated that screen printing remains a preferred process in the context of the invention. An alternative may for instance consist in using a flexographic-printing unit as the respective application unit. According to another preferred embodiment of the invention, the in-line casting device may advantageously comprise at least one embossing tool with an embossing form, e.g. an embossing cylinder, acting as carrier supporting a replicating medium designed to replicate and form the micro-optical structure in the layer of material acting as optical medium. In this context, it is particularly advantageous to additionally provide at least one pressure cylinder or roller cooperating with the embossing cylinder to press the substrate against the replicating medium, which ensures optimal replication and formation of the relevant micro-optical structures. The aforementioned embossing cylinder could in particular be located immediately after the aforementioned application unit.

In a preferred embodiment, the material acting as optical medium preferably can be applied directly onto the substrate before being brought into contact with the embossing tool, i.e. the embossing cylinder. The application in this case is being placed at the substrate path upstream the embossing tool.

In an alternative embodiment, the material acting as optical medium can be applied directly onto the embossing form, e.g. onto the surface of the embossing cylinder before the substrate being arranged on it. The application unit in this case is being placed at the embossing tool, preferably at the circumference of the embossing cylinder, especially in a peripheral section between delivery and take over of the substrate.

Although the casting device can be designed that the embossing cylinder to act onto the substrate only in a nip with a transport or conveying cylinder carrying the substrate, in a preferred embodiment, the embossing cylinder acts as a transport or conveying cylinder carrying and/or supporting the substrate over a—especially significant—angle range, e.g. for at least 90° of revolution.

By way of preference, the printing press could further comprise a washing device that can selectively be brought in contact with the embossing cylinder during maintenance operations to clean the surface of the embossing cylinder. This would be particularly advantageous in facilitating removal of residues of the material used to form the micro-optical structure.

Furthermore, the printing press could advantageously be designed as a sheet-fed printing press adapted to carry out printing on individual sheets, wherein transfer of the sheets between the in-line casting device and the printing unit is carried out exclusively from cylinder to cylinder via cooperating cylinder grippers, which solution ensure optimal register accuracy between the print and the associated micro-optical structure.

According to a further embodiment of the invention, the in-line casting device could further be provided with at least one drying/curing unit (preferably a UV-curing unit, advantageously such as a UV-LED curing unit) to dry or cure the layer of material acting as optical medium during and/or following replication of the micro-optical structure in the layer of material acting as optical medium.

This could advantageously be performed by means of a drying/curing unit located to dry or cure the layer of material acting as optical medium from the side of the substrate which is opposite to the side of the substrate where the micro-optical structure is replicated, especially while the substrate is still being processed on the aforementioned embossing cylinder (in which case the drying/curing unit is to be located about a portion of the circumference of the embossing cylinder.

Alternatively, or in addition to the above measures, a drying/curing unit could be located to dry or cure the layer of material acting as optical medium from the side of the substrate where the micro-optical structure is replicated, especially while the substrate is being transported by a transfer cylinder located immediately after the aforementioned embossing cylinder (in which case the drying/curing unit is to be located about a portion of the circumference of this transfer cylinder).

The printing press of the invention can in particular be of a type where the printing unit is designed to operate as an indirect printing unit, e.g. such as an offset or indirect relief printing unit in the above sense, especially a Simultan-type printing unit, especially Simultan-type offset printing unit—preferably in the above sense—for the simultaneous recto-verso printing of the substrate.

By way of preference, the micro-optical structure is replicated by the in-line casting device upstream of a location where the printed pattern is printed by the printing unit. Within the scope of the present invention, the in-line casting device could however be provided at any appropriate location in the printing press, be it after the relevant printing unit or between two printing units, or even form an integral part of a printing unit.

Further advantageous embodiments of the invention form the subject-matter of the dependent claims and are discussed below.

BRIEF DESCRIPTION OF THE DRAWINGS

Other features and advantages of the present invention will appear more clearly from reading the following detailed description of embodiments of the invention which are presented solely by way of non-restrictive examples and illustrated by the attached drawings in which.

DETAILED DESCRIPTION OF EMBODIMENTS OF THE INVENTION

Figure 4:
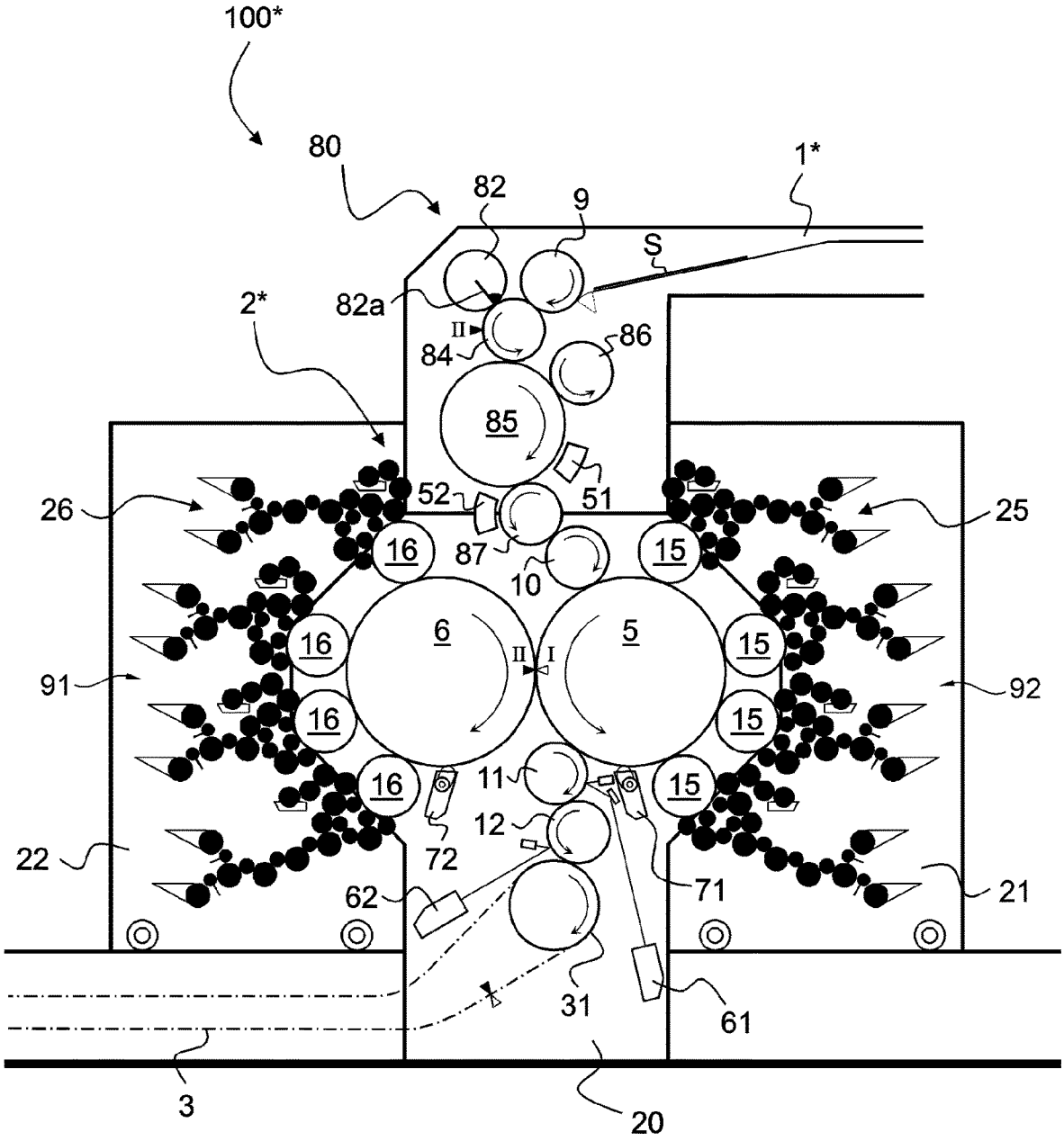
FIG. 4 is a schematic partial side view of the printing unit of a printing press in accordance with a first embodiment of the invention.
Figure 5:
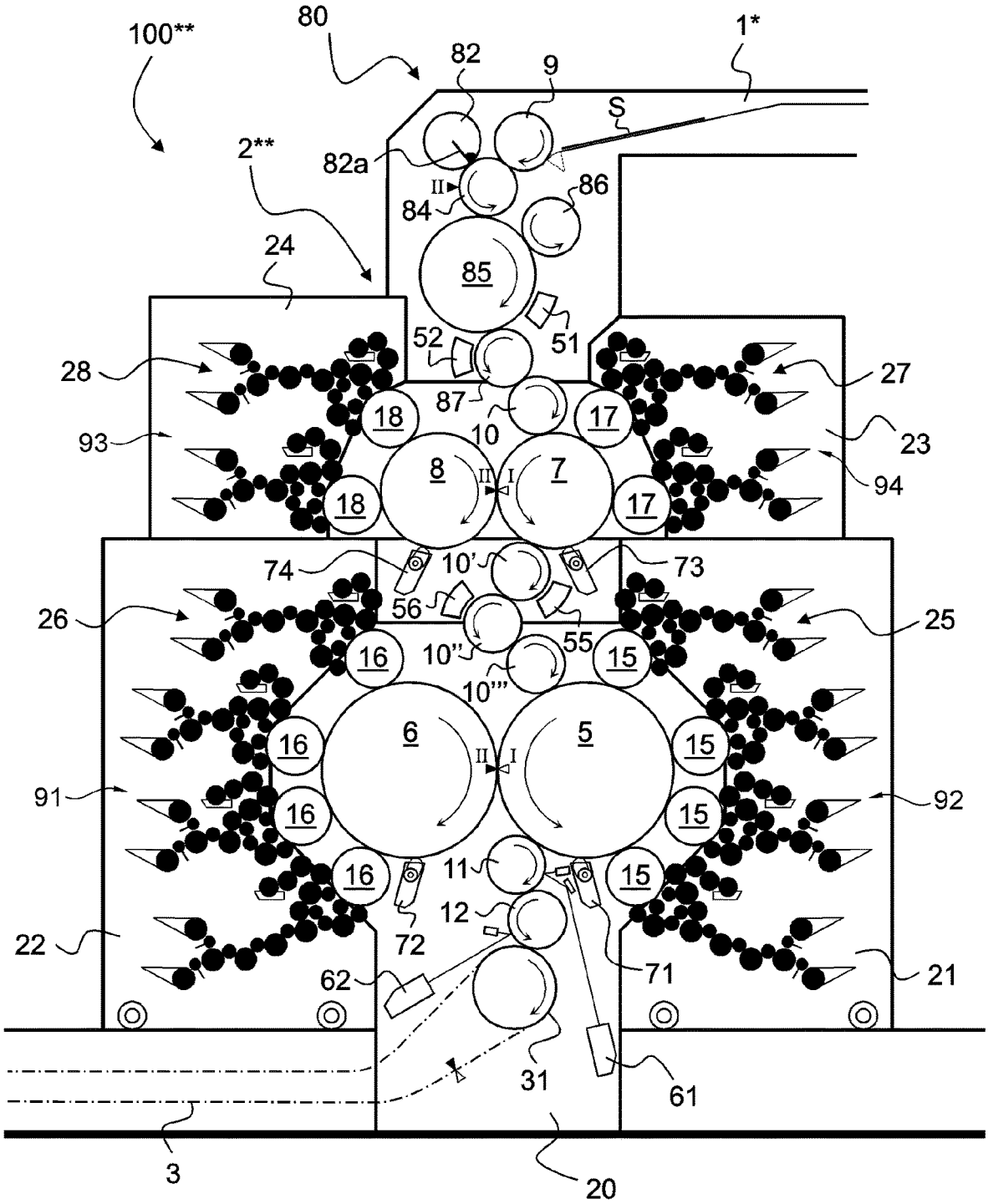
FIG. 5 is a schematic partial side view of the printing unit of a printing press in accordance with a second embodiment of the invention.
Figure 6:
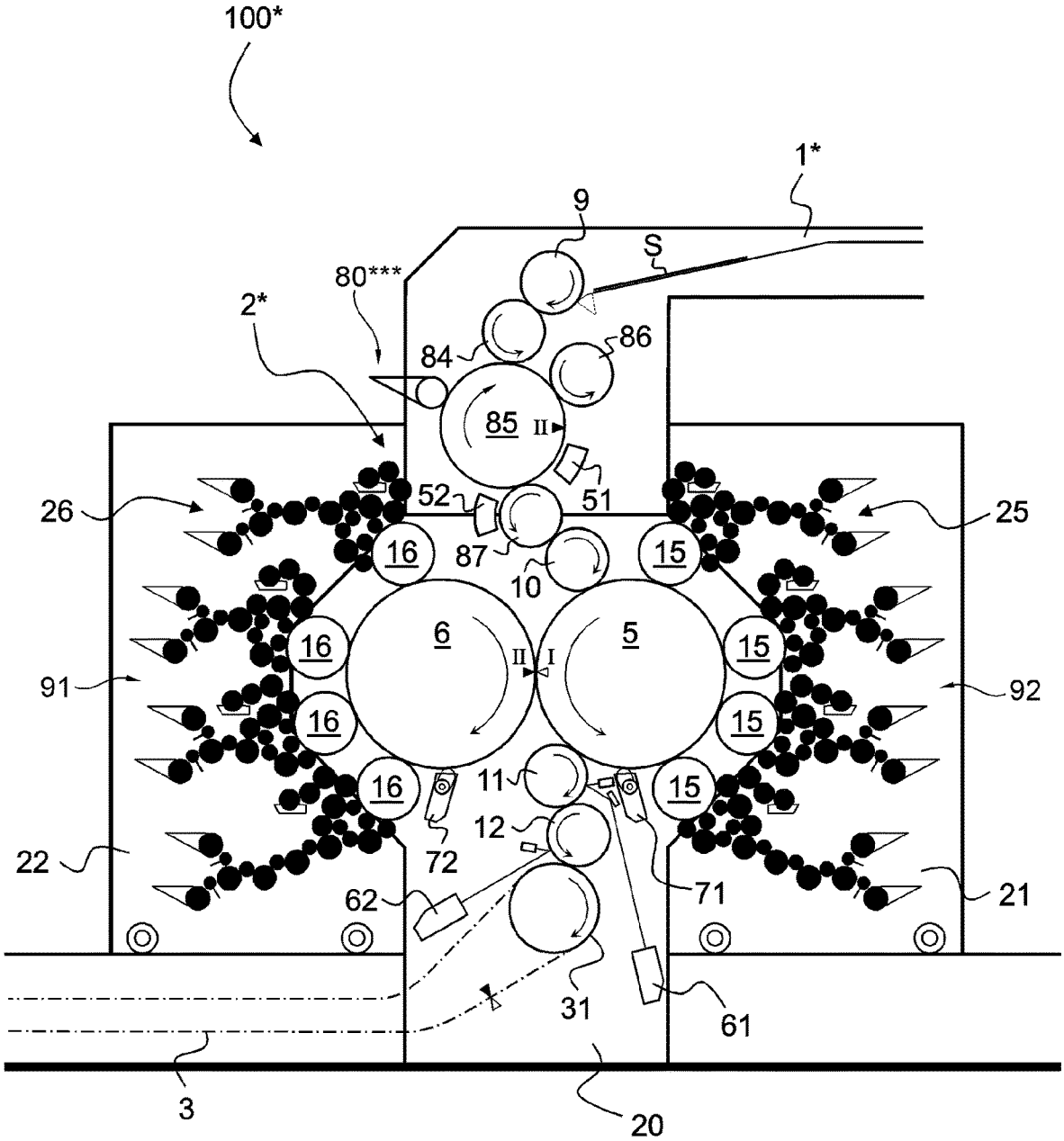
FIG. 6 is a schematic partial side view of the printing unit of a printing press in accordance with a variant to the second embodiment of the invention.

Although the present invention in principle is not limited to such an embodiment of the printing press respectively printing unit, it will be described in the particular context of preferred embodiments of a printing press, preferably sheet fed printing press, comprising a printing unit with at least a printing group (91; 92; 93; 94) designed as an collect printing group (91; 92; 93; 94) as mentioned above and/or a, preferably sheet-fed, recto-verso printing press, especially based on indirect printing, exhibiting a (m)-over-(m) configuration (see embodiment of FIG. 4 where m equals 4), a (m+n)-over-(m+n) configuration (see embodiment of FIG. 5 where m, n respectively equal 4 and 2), or a (m)-over-(m+n) configuration (see embodiments of FIGS. 6 and 7 where m, n respectively equal 4 and 3). The expression "(m)-over-(m) configuration" is to be understood as a simultaneous recto-verso printing with m colour separations or frames printed on each side and/or a configuration of a recto-verso printing press, printing unit or group comprising a first set of m plate cylinders cooperating with a first printing cylinder and a second set of m plate cylinders cooperating with a second printing cylinder, which first and second printing cylinders cooperate to build a common printing nip. It shall be appreciated however that the invention is not limited to these particular printing press configurations, the number of plate cylinders being purely illustrative. This being said, the printing press configurations as shown in FIGS. 4 to 6 are of particular advantage as they allow very high colour-to-colour register accuracy.

An collect printing group (91; 92; 93; 94) is designed to print at least one side of the substrate by firstly collecting several impressions or patterns from several plate cylinders on a cylinder, e.g. a so called collecting cylinder, before being printed as a collected image as a whole onto the substrate.

In the context of the present invention, the expression "printing cylinder(s)" will be used to designate the relevant cylinders of a printing group (91; 92; 93; 94), e.g. of a main printing group (91, 92) and of any additional printing group (93, 94), that directly cooperate with the first and second sides of the substrates (e.g. sheets) to transfer printing patterns thereon. This expression preferably is interchangeable with the expression "transfer cylinder" or "blanket cylinder", it being to be understood that the relevant printing cylinders for example each carry an number, e.g. one or several, printing blankets.

The expression "printing group" (91; 92; 93, 94) will be used for the equipment, e.g. the cylinders, rollers and the means of the inking unit(s), belonging to a printing nip for at least printing on one side of the substrate. A double sided printing group (91, 92; 93, 94) therefor is a special printing group (91, 92; 93, 94) with two printing groups (91; 92; 93; 94), one on or for each side of the substrate path, sharing a same printing nip for printing simultaneously both sides of a passing substrate and mutually acting with its printing cylinders as counter-pressure cylinders for the other printing group (92; 91; 94; 93).

It is to be understood, that several printing groups 91; 92; 93; 94 can be arranged in a same printing unit 2; 2*; 2; 2***; 2****, with these printing groups 91; 92; 93; 94** for example being arranged in single- or multi-part frame walls.

The expression "first side" (designated by reference I) and "second side" (designated by reference II) are used in the following description to designate the two opposite sides of the sheets being printed. More precisely, in the illustrations of FIGS. 4 to 6, the "first side" I designates the side of the sheets that is designated by the white triangles, while the "second side" II designates the side of the sheets that is designated by the black triangles. These expressions are however interchangeable.

Figure 3A:
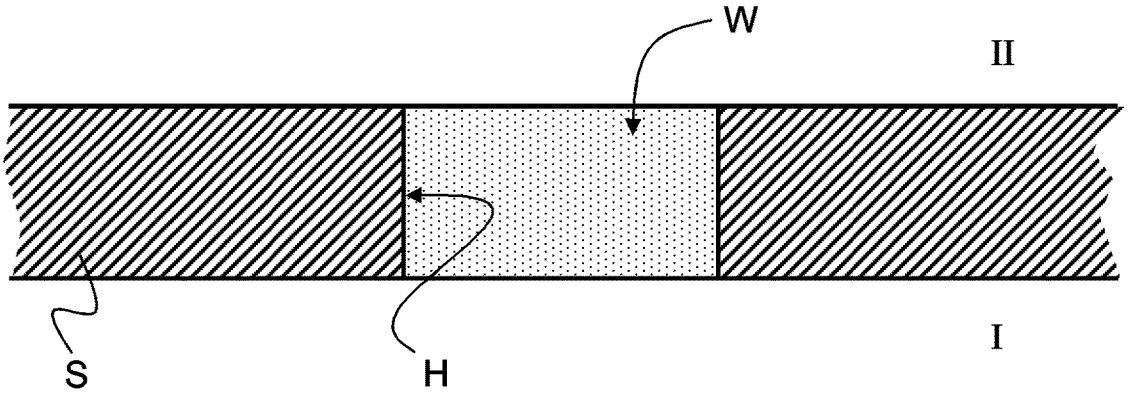
FIGS. 3A and 3B are schematic illustrations of a substrate that is provided with a micro-optical structure on top of a window-forming portion created in the substrate.
Figure 3B:
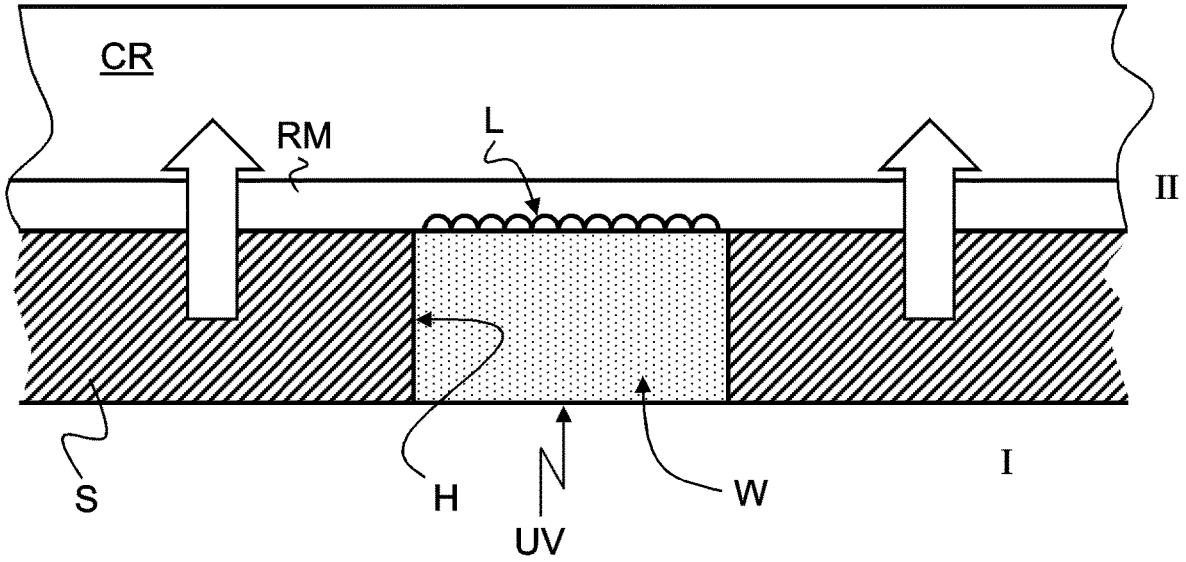

FIGS. 3A-B schematically illustrate an example of a substrate S that is provided with an opening (or through-hole) H extending through the substrate S. This opening H is preferably filled by a suitable filling material, which material is preferably substantially transparent, so as to form a transparent or substantially transparent window W visible from both sides I, II of the substrate S. The particular shape and geometry of the opening H and resulting window W may be varied depending on the design requirements. The cross-sectional shape of the opening H could also be different from the depicted example.

In accordance with the invention, one wishes to replicate a micro-optical structure L on one or the other side of the substrate S. More precisely, according to the illustrated example, one wishes to replicate a micro-optical structure L, such as a field of micro-lenses, on top of the window W, on the second side II of the substrate S. To this end, side II of the substrate S is first provided in the relevant portion of the substrate S with a layer of material acting as an optical medium (for instance by means of a suitable screen-printing unit as discussed hereafter) before being brought into contact with and pressed against the surface of a replicating medium RM that is provided with a corresponding replicating structure (formed as a recessed structure in the surface of the replicating medium RM). Any desired shape and geometry could be imparted to the replicating structure in order to form the desired micro-optical structure L.

As schematically illustrated in FIG. 3B, the replicating medium RM is conveniently carried by a suitable carrier CR, especially a cylinder acting as embossing cylinder as described hereinafter.

Subsequent to, or preferably during the replication process, the relevant material acting as optical medium is subjected to a drying or curing process (especially a UV-curing process). This is preferably carried out, as schematically illustrated in FIG. 3B, while the substrate S is still in contact with the replicating medium RM, advantageously by subjecting the substrate S and the relevant material acting as optical medium to UV radiation from the first side I of the substrate, through the window portion W.

It should be appreciated that the invention is equally applicable to other types of substrates than the one illustrated in FIGS. 3A-B, especially polymer or hybrid substrates as for instance described in International Publication No. WO 2014/125454 A1. The illustrations of FIGS. 3A-B are therefore by no way limiting the application scope of the present invention and the substrate material can be any suitable substrate material that can be used as printable material, such as paper, polymer, or combinations thereof.

FIG. 4 schematically shows a partial side view of a printing unit, designated by reference numeral 2*, of a printing press 100* in accordance with a first embodiment of the invention.

The printing press 100* in this embodiment comprises a printing group 91, 92, especially as a main printing group 91, 92, which comprises two printing groups 90; 91, one for each side of the substrate path, forming a so-called double sided printing group 91, 92 for simultaneous printing on both sides. This double sided printing group 91, 92 consists of elements 5, 6, 15, 16, 25, 26, including first and second printing cylinders 5, 6 cooperating with one another to form a first printing nip between the first and second printing cylinders 5, 6, especially transfer cylinder, where the first and second sides I, II of the sheets S are simultaneously printed, the first printing cylinder 5 acting as a sheet conveying cylinder of the main respectively double sided printing group. The configuration of the main printing group for example is as such identical to that of the main printing group illustrated in FIGS. 1 and 2. In this embodiment, printing cylinders 5, 6 are likewise three-segment cylinders which are supported between a pair of side frames 20. The printing cylinders 5, 6 serve as ink collecting cylinders 5, 6 and receive and collect different ink patterns in their respective colours from first and second sets of four (m=4) plate cylinders 15, respectively 16, which are distributed around a portion of the circumference of the printing cylinders 5, 6. These plate cylinders 15 and 16, which each carry a corresponding printing plate, are again inked by corresponding sets of four inking apparatuses 25 and 26, respectively. The two sets of inking apparatuses 25, 26 are preferably supported in two retractable inking carriages 21, 22 that can be moved toward or away from the centrally-located plate cylinders 15, 16 and printing cylinders 5, 6.

Figure 1:
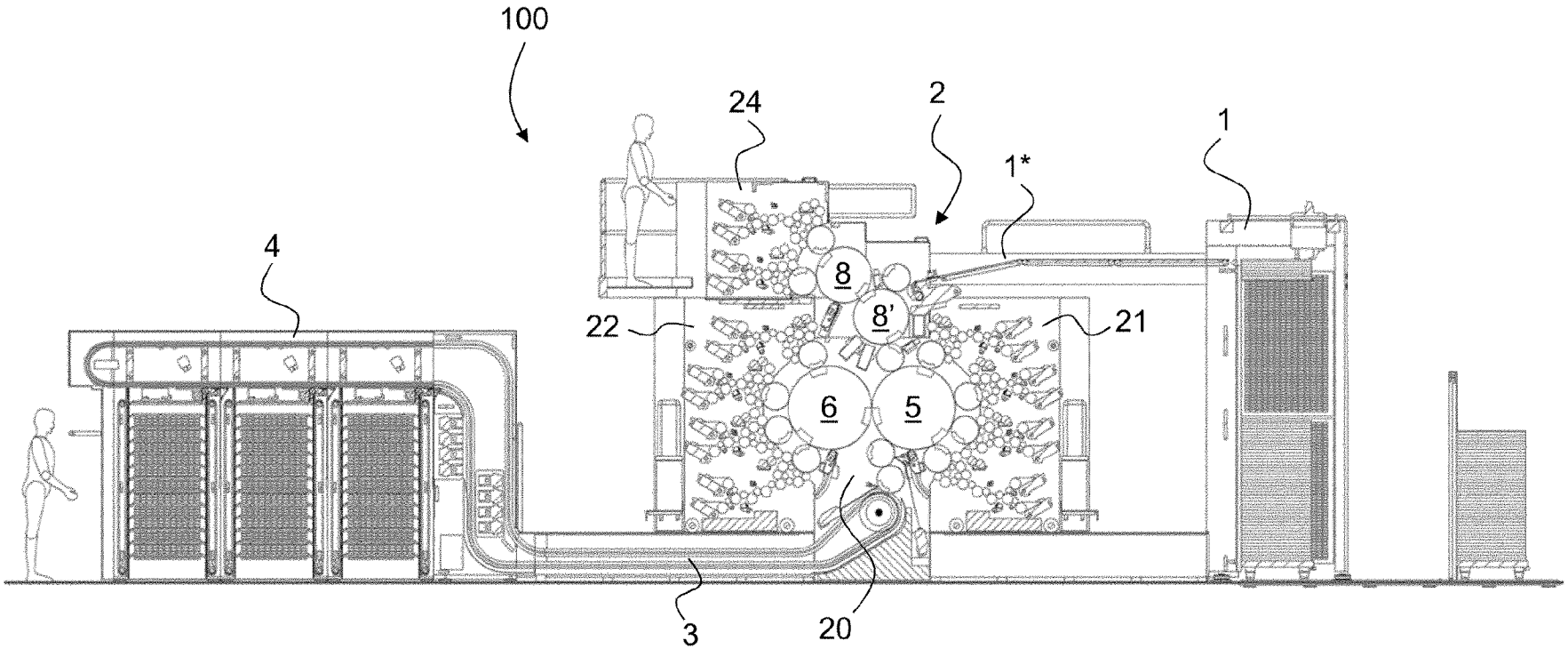
Fig. 1 (PRIOR ART)
FIG. 1 is schematic illustration of recto-verso printing press exhibiting a configuration similar to that disclosed in International PCT Publication No. WO 2007/042919 A2.
Figure 2:
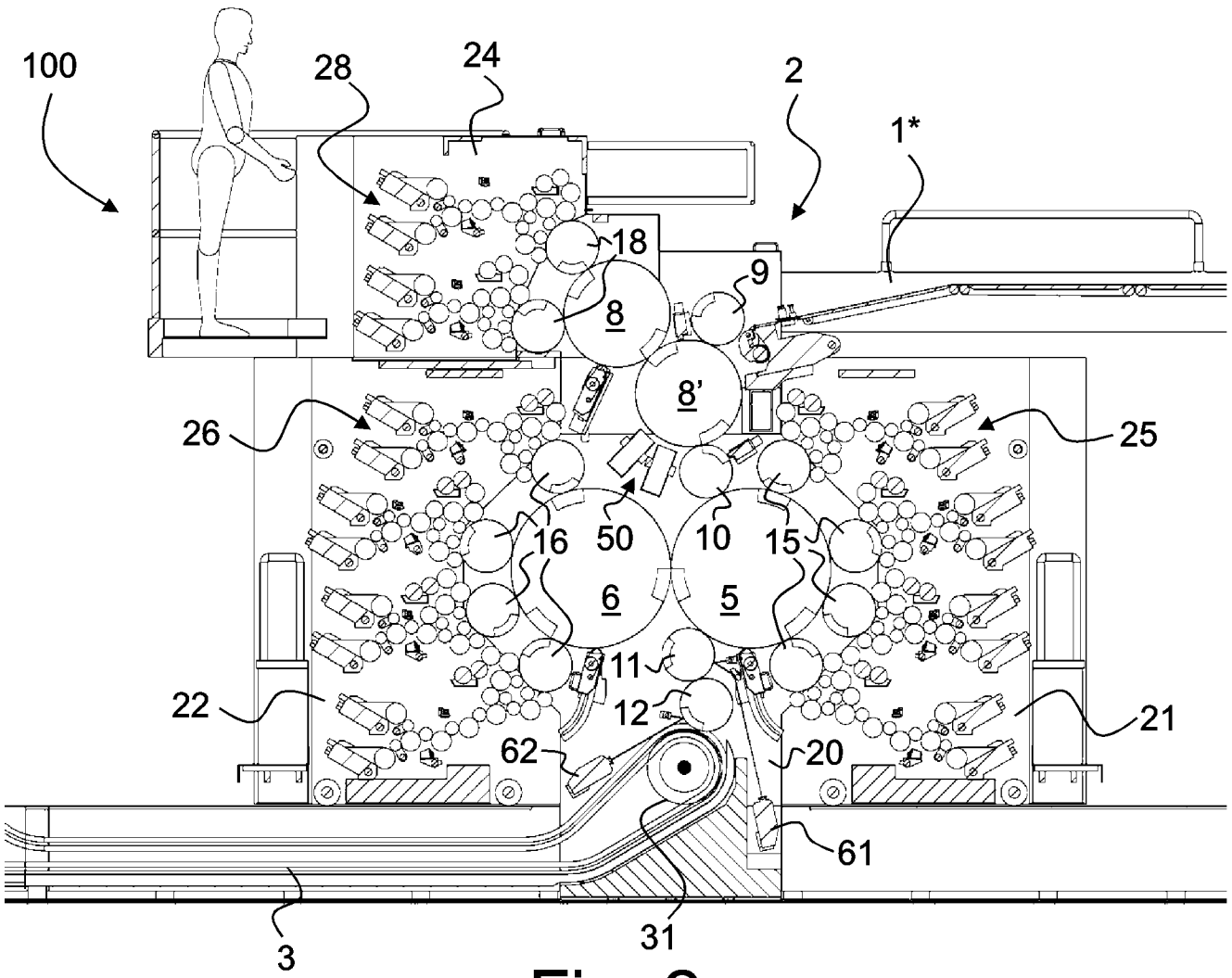
Fig. 2 (PRIOR ART)
FIG. 2 is a schematic partial side view of the printing unit of the printing press of FIG. 1.

In contrast to the configuration illustrated in FIGS. 1 and 2, no additional printing group is provided upstream of the main printing group. Instead, an in-line casting device 80 is interposed between the transfer cylinder 9 located at the infeed and the transfer cylinder 10 that transfers the sheets to the main printing group, which in-line casting device 80 will now be described.

In a variant of the first embodiment depicted in FIG. 4, the printing unit 2 can be designed as a on side printing group 91, i.e. can comprise a printing group 91 only on one side of the substrate path.

In this and in the following embodiments, the press 100* or printing unit 2 or main printing group 91; 92 comprises at least one printing group 91; 93 on that side of the substrate path for printing onto the substrate side I; II which opposes the side II, I having already been or still have to be provided with the micro-optical structure upstream. Preferably, this at least one printing group 91; 93 is designed as above mentioned collect printing group 91; 93.

By way of preference—at least for embodiments with application of the material directly onto the substrate—the in-line casting device 80 depicted in FIG. 4 (and in FIG. 5) is of the type comprising a screen-printing unit 82, 82*a*, 84, namely a printing unit comprising a rotary screen cylinder 82 inside which is provided a squeegee device 82*a*, which rotary screen cylinder 82 cooperates with an impression cylinder 84, serving as a counter-pressure cylinder, onto which the sheets S are fed in succession from the transfer cylinder 9 at the infeed. More precisely, in according with this first embodiment, the sheets S are transferred in succession to the impression cylinder 84 which supports the first side I of the sheets S and the rotary screen cylinder 82 is brought in contact with the second side II of the sheets S. In this particular context, the screen-printing unit 82, 82*a*, 84 is adapted to apply a layer of material acting as an optical medium on a portion of the second side II of the sheets S (for instance on a window-forming region W formed in the substrate S as depicted in FIGS. 3A-3B). The relevant material could be any suitable material, especially a transparent polymer material that is preferably curable by UV radiation.

In principle, the application unit could alternatively be designed to apply a layer of material acting as the optical medium on a portion of the first side I of the sheets S (for instance on a window-forming region W formed in the substrate S as depicted in FIGS. 3A-3B, however on side I rather than on side II). The substrate then will be moved with its first side facing the surface of the embossing cylinder 84 and preferably will be printed downstream at least onto its other side, here side II.

The aforementioned screen-printing unit 82, 82*a*, 84 is designed to act a first application unit for applying the required layer of material where the micro-optical structure is to be replicated. The configuration and operation of the screen-printing unit 82, 82*a*, 84 is known as such in the art and does not need to be described in detail. Reference can in particular be made to European Patent Publication No. EP 0 723 864 A1 in the name of the present Applicant, which is incorporated herein by reference in its entirety.

In the illustration of FIG. 4 (and FIGS. 5 and 7), only one screen-printing unit is depicted. It should however be appreciated that multiple screen-printing units could be provided, which screen-printing units could cooperate with one and a same impression cylinder. Furthermore, while screen printing is a preferred process for applying the required material, other application processes could be contemplated. For instance, flexographic printing could be contemplated as well (not depicted).

Downstream of the impression cylinder 84, there is preferably provided at least one embossing cylinder 85, serving as embossing tool, which cooperates with the second side II of the sheets S, i.e. the side where the layer of material acting as optical medium was applied by the application unit 82, 82*a*, 84, especially screen-printing unit 82, 82*a*, 84. This embossing cylinder 85 preferably carries on its circumference a replicating medium RM (as schematically illustrated in FIG. 3B) designed to replicate a micro-optical structure L, such as but not limited to a field of micro-lenses, into the layer of material applied on the sheets S. In that respect, the screen-printing unit 82, 82*a*, 84 should be adapted to supply a sufficient amount of material to fill the recessed portion of the replicating medium RM.

A pressure roller or cylinder 86 is furthermore advantageously provided about the circumference of the embossing cylinder 85 in order to cooperate with the first side I of the sheets S and press the sheets S against the circumference of the embossing cylinder 85 (and the surface of the replicating medium RM located thereon), thereby ensuring proper replication of the micro-optical structure L into the layer of material acting as optical medium.

The in-line casting device 80 further comprises a first drying/curing unit 51 located about a portion of the circumference of the embossing cylinder 85, downstream of the possibly pressure roller or cylinder 86, to dry or cure the layer of material acting as optical medium while the sheets S are still being processed and pressed against the circumference of the embossing cylinder 85 and the surface of the replicating medium RM located thereon, thereby ensuring optimal replication and formation of the desired micro-optical structure L. In this context, it shall be understood that the drying/curing operation is carried out from the side opposite to the side being provided with the layer to be cured, here for example the first side I of the substrate, e.g. sheets S, which is especially adequate in the event that the micro-optical structure L is replicated on top of a window-forming portion W as schematically illustrated in FIG. 3B.

Alternatively, or in addition to the aforementioned drying/curing unit 51, the in-line casting device 80 could be provided with a (second) drying/curing unit 52 located about a portion of the circumference of a transfer cylinder 87 that is located immediately after the embossing cylinder 85 as depicted in FIG. 4. In this case, it shall be understood that the drying/curing operation is carried out from the second side II of the sheets S, where the micro-optical structure L has been replicated.

The aforementioned drying/curing units 51, 52 could advantageously be UV-curing units, especially UV-LED curing units, in which case the relevant layer of material acting as optical medium evidently has to be a UV-curable material.

Subsequent to the replication of the micro-optical structure L, the sheets S are transferred to the downstream-located printing unit 2*, namely to the sheet transfer cylinder 10.

In accordance with this first embodiment, the sheets S are accordingly fed in succession from the sheet feeder (not shown in FIG. 4) onto the feeder table 1* where they are conventionally aligned before being fed to the sheet transfer cylinder 9 at the infeed. As illustrated, the sheets are fed in succession by the sheet transfer cylinder 9 to and through the in-line casting device 80 (via cylinders 84, 85 and 87) to the transfer cylinder 10 and then to the first printing cylinder 5 of the main printing group 91, 92.

It will therefore be appreciated in this embodiment that the sheets S are initially provided with micro-optical structures L on side II and then receive at least first impressions on the opposite side I, preferably first and second impressions on both sides I, II, which impressions are performed simultaneously at the printing nip between the first and second printing cylinders 5, 6 of the main printing group 91, 92. It will also be appreciated that transfer of the sheets S from the in-line casting device 80 to the printing unit 2* is carried out exclusively from cylinder to cylinder via cooperating cylinder grippers. Optimal register accuracy between the micro-optical structures L that are replicated by means of the embossing cylinder 85 and the impressions performed by the printing unit 2* is thereby guaranteed.

FIG. 5 schematically shows a partial side view of a printing unit, designated by reference numeral 2, of a printing press 100**** in accordance with a second embodiment of the invention.

This printing press 100 shares a number of common features with the first embodiment of FIG. 4, in particular the same basic components 5, 6, 15, 16, 25, 26 constitutive of the main printing group 91, 92 and the same basic components 82, 82***a*, 84, 85, 86, 87, 51, 52 constitutive of the in-line casting device 80. The difference between this second embodiment and the first embodiment resides in that an additional printing group 93, 94 is interposed between the in-line casting device 80 and the main printing group. More precisely, the printing press 100 of FIG. 5 comprises third and fourth printing cylinders 7, 8 cooperating with one another to form a second printing nip between the third and fourth printing cylinders 7, 8 where the first and second sides I, II of the sheets S are simultaneously printed, the third printing cylinder 7 acting as a sheet conveying cylinder of the additional printing group 93, 94. Each printing cylinder 7, 8 collects inks from corresponding sets of two (n=2) plate cylinders 17, respectively 18, that are inked by corresponding inking apparatuses 27, 28. These two sets of inking apparatuses 27, 28 are likewise preferably supported in two retractable inking carriages 23, 24 that can be moved toward or away from the centrally-located plate cylinders 17, 18 and printing cylinders 7, 8**.

Alternatively, the sets of inking apparatus 25, 27 on the right side of the printing unit 2 and/or the sets of inking apparatus 26, 28 on the left side of the printing unit 2 could be supported in one and a same inking carriage (one on each side).

In the illustrated example, the additional printing group 93, 94 with the basic components 7, 8, 17, 18, 27, 28 is placed upstream of and above the main printing group 91, 92, the first and second printing cylinders 5, 6, on the one hand, and the third and fourth printing cylinders 7, 8, on the other hand, being advantageously aligned along two horizontal planes.

The main printing group 91, 92, comprising the basic components 5, 6, 15, 16, 25, 26, and the additional printing group 93, 94, comprising the basic components 7, 8, 17, 18, 27, 28, are coupled to one another by means of an intermediate sheet conveying system comprising, in the illustrated embodiment, first to third sheet-transfer cylinders 10', 10", 10'" interposed between the first and third printing cylinders 5, 7. More precisely, the sheets printed in the additional printing group 93, 94 are transferred from the third printing cylinder 7 in succession to the first sheet-transfer cylinders 10', to the second sheet-transfer cylinders 10", to the third sheet-transfer cylinder 10'", and then to the first printing cylinder 5 of the main printing group 91, 92.

On their way to the main printing group 91, 92, the sheets are preferably dried/cured by third and fourth drying/curing units 55, 56. As illustrated, the third drying/curing unit 55 advantageously cooperates with the first sheet-transfer cylinder 10', i.e. the sheet-transfer cylinder located immediately downstream of the third printing cylinder 7, and the fourth drying/curing unit 56 cooperates with the second sheet-transfer cylinder 10". The drying/curing units 55, 56 are advantageously UV curing units, preferably UV-LED curing units.

Drying/curing of the second side II of the sheets could alternatively be performed directly onto the third printing cylinder 7, provided suitable measures are taken to ensure that the drying/curing unit does not degrade the performance or usability of the printing blankets on the third printing cylinder 7.

In accordance with this other embodiment, the sheets S are accordingly fed in succession from the sheet feeder (not shown in FIG. 5) onto the feeder table 1* where they are once again conventionally aligned before being fed to the sheet transfer cylinder 9 at the infeed. As illustrated, the sheets are then fed in succession by the sheet transfer cylinder 9 to and through the in-line casting device 80 (via cylinders 84, 85 and 87) to the transfer cylinder 10, to the third printing cylinder 7 of the additional printing group 93, 94 and then to the first printing cylinder 5 of the main printing group 91, 92 via the three intermediate sheet transfer cylinders 10' to 10'".

It will therefore be appreciated that the sheets S are initially provided with micro-optical structures L on side II and then receive first and second impressions on both sides I, II, which impressions are performed simultaneously at the printing nip between the third and fourth printing cylinders 7, 8 of the additional printing group and at the printing nip between the first and second printing cylinders 5, 6 of the main printing group. It will likewise also be appreciated that transfer of the sheets S from the in-line casting device 80 to the printing unit 2 is carried out exclusively from cylinder to cylinder via cooperating cylinder grippers. Optimal register accuracy between the micro-optical structures L that are replicated by means of the embossing cylinder 85 and the impressions performed by the printing unit 2**** is once again guaranteed.

FIG. 6 shows an alternative embodiment for applying the material acting as optical medium. In this embodiment, the material acting as optical medium is applied directly onto the embossing form, e.g. onto the surface of the embossing cylinder 85 before the substrate, i.e. the sheet S, being arranged on it. In this case the application unit is being placed at the embossing tool, preferably at the circumference of the embossing cylinder 85, especially in a peripheral section between take over and delivery of the substrate, respectively sheet S. The application unit can be designed as a screen printing unit or flexographic-printing unit as above, but preferably it is designed like an inking apparatus with at least a fountain roller receiving the material from a reservoir and directly or through other rollers transfer the material onto the surface of the embossing cylinder 85.

The embodiment with direct application onto the embossing cylinder 85 described in the context of the first embodiment is to be transferred to the second embodiment.

It should be appreciated that the actual numbers m and n of plate cylinders 15, 16, 17, 18 illustrated in FIGS. 4 to 6 are not limitative and that other combinations are possible. This being said, the illustrated examples are particularly advantageous in that machine footprint is limited and machine operability and accessibility are not compromised.

As a possible refinement of the invention, as illustrated in FIGS. 4 to 6, it may be convenient to additionally provide the printing press with a recto-verso inspection system 11, 12, 61, 62 adapted to inspect the first and second sides I, II of the sheets printed by the additional printing group and the main printing group, including the micro-optical structures formed by means on the in-line casting device 80.

Furthermore, the printing presses 100* of FIGS. 4 and 6 and 100 of FIG. 5 can also conveniently equipped, as illustrated, with automatic blanket washing devices 71, 72, 73, 74 adapted to clean the surface of the first, second, third and fourth printing cylinders 5, 6, 7, 8**, respectively, during maintenance operations.

Various modifications and/or improvements may be made to the above-described embodiments without departing from the scope of the invention as defined by the annexed claims. In particular, while the embodiments of the invention where described with reference to sheet-fed printing press configurations, the invention could equally be applied to print on web-like substrates, i.e. successive portions of a continuous web of printable material.

Furthermore, the in-line casting device could be adapted to apply a layer of material acting as an optical medium on a portion of either the first or second side of the substrate and to replicate and form the micro-optical structure accordingly. In that respect, the configurations of the in-line casting devices 80, 80*, 80 shown in FIGS. 4 to 7** are only illustrative of possible machine configurations.

LIST OF REFERENCE NUMERALS USED THEREIN

100 printing press (prior art of FIGS. 1 and 2)
100* printing press (first embodiment of FIGS. 4 and 6)
100 printing press (second embodiment of FIG. 5**)
1 substrate feeding device, sheet feeder
1* feeder table
S substrate material (e.g. individual sheets)
I first side ("side I" or "recto side") of the substrate material S
II second side ("side II" or "verso side") of the substrate material S
H through opening in substrate S
W window-forming portion of substrate S
L micro-optical structure (e.g. lens structure) replicated/formed into a layer of material acting as optical medium applied on e.g. side II of the substrate material S
RM replicating medium used to replicate and form the micro-optical structure L
CR carrier supporting the replicating medium RM (e.g. embossing cylinder 85—embodiments of FIGS. 4 to 7)
2 printing unit (prior art of FIGS. 1 and 2)
2* printing unit (first embodiment of FIGS. 4 and 6)
2 printing unit (second embodiment of FIG. 5**)
3 sheet conveying system (chain gripper system with spaced-apart gripper bars)
4 substrate delivery unit, sheet delivery unit
5 sheet conveying cylinder/(first) printing cylinder (main printing group)/three-segment blanket cylinder
6 (second) printing cylinder (main printing group)/three-segment blanket cylinder
7 sheet conveying cylinder/(third) printing cylinder (additional printing group)/two-segment blanket cylinder (embodiment of FIG. 5 only)
8 (third, resp. fourth) printing cylinder (additional printing group)/two-segment blanket cylinder (prior art of FIGS. 1, 2/second to fourth embodiments of FIGS. 5 to 7)
8' sheet conveying cylinder/two-segment cylinder (prior art of FIGS. 1 and 2 only)
9 sheet transfer cylinder (infeed)
9' sheet transfer cylinder (third and fourth embodiments of FIGS. 6 and 7)
10 sheet transfer cylinder (prior art of FIGS. 1, 2/first and second embodiments of FIGS. 4 and 5)
10', 10", 10'" sheet transfer cylinders (intermediate sheet conveying system interposed between additional printing group and main printing group—embodiments of FIGS. 5 to 7 only)
11 inspection cylinder or drum (part of inspection system)
12 inspection cylinder or drum (part of inspection system)
15 (m=4) plate cylinders cooperating with printing cylinder 5
16 (m=4) plate cylinders cooperating with printing cylinder 6
17 (n=2) plate cylinders cooperating with printing cylinder 7 (embodiment of FIG. 5)
18 (n=2, resp. 3) plate cylinders cooperating with printing cylinder 8 (prior art of FIGS. 1, 2/second to fourth embodiments of FIGS. 5 to 7)
20 printing press main frame
21 retractable inking carriage supporting inking apparatuses 25
22 retractable inking carriage supporting inking apparatuses 26
23 retractable inking carriage supporting inking apparatuses 27 (embodiment of FIG. 5)
24 retractable inking carriage supporting inking apparatuses 28 (prior art of FIGS. 1, 2/second to fourth embodiments of FIGS. 5 to 7)
25 (m=4) inking apparatuses each cooperating with a corresponding one of the plate cylinders 15
26 (m=4) inking apparatuses each cooperating with a corresponding one of the plate cylinders 16
27 (n=2) inking apparatuses each cooperating with a corresponding one of the plate cylinders 17 (embodiment of FIG. 5)
28 (n=2, resp. 3) inking apparatuses each cooperating with a corresponding one of the plate cylinders 18 (prior art of FIGS. 1, 2/second to fourth embodiments of FIGS. 5 to 7)
31 pair of chain wheels of sheet conveying system 3 (upstream end)
50 drying/curing unit (prior art of FIGS. 1, 2)
51 (first) drying/curing unit acting on side I of the sheets S, e.g. UV-LED curing unit (located about a portion of the circumference of embossing cylinder 85)
52 (second) drying/curing unit acting on side II of the sheets S, e.g. UV-LED curing unit (located about a portion of the circumference of transfer cylinder 87/first and second embodiments of FIGS. 4 and 5)
55 (third, resp. second) drying/curing unit acting on side I of the sheets S, e.g. UV-LED curing unit (located about a portion of the circumference of transfer cylinder 10'/embodiments of FIGS. 5 to 7)
56 (fourth, resp. third) drying/curing unit acting on side II of the sheets S, e.g. UV-LED curing unit (located about a portion of the circumference of transfer cylinder 10"/embodiments of FIGS. 5 to 7)
61 inspection camera (side I of the sheets S) cooperating with inspection cylinder or drum 11, e.g. line-scan camera
62 inspection camera (side II of the sheets S) cooperating with inspection cylinder or drum 12, e.g. line-scan camera
71 automatic blanket washing device cooperating with printing cylinder 5
72 automatic blanket washing device cooperating with printing cylinder 6

73 automatic blanket washing device cooperating with printing cylinder 7 (embodiment of FIG. 5)

74 automatic blanket washing device cooperating with printing cylinder 8 (embodiment of FIG. 5)

80 in-line casting device for the application of a layer of material acting as optical medium and for the replication and formation of the micro-optical structure L in the said layer of material acting as optical medium

82 screen-printing cylinder (part of the screen-printing unit acting as application unit for the layer of material acting as optical medium/first to third embodiments of FIGS. 4 to 6)

82*a* squeegee device of screen-printing cylinder 82

84 impression cylinder (remaining part of the screen-printing unit acting as application unit for the layer of material acting as optical medium)

85 embossing cylinder carrying replicating medium RM for the replication and formation of the micro-optical structure L

86 pressure cylinder or roller cooperating with embossing cylinder 85

87 transfer cylinder cooperating with embossing cylinder 85 for transfer of the sheets S to the downstream-located printing unit 2*, 2**

91 printing group, preferably collect printing group

92 printing group, preferably collect printing group

93 printing group, preferably collect printing group

The invention claimed is:

1. A sheet-fed printing press adapted to carry out printing on individual sheet-like substrates for the production of bank notes, the printing press comprising:

a sheet-like polymer substrate with an opaque portion and a transparent portion, the substrate comprising:

a first side; and a second side opposite the first side, the transparent portion extending from the first side to the second side;

a substrate feeding device configured to feed the substrate;

a delivery unit configured to receive the substrate;

an in-line casting device adapted to apply a layer of material acting as an optical medium directly on the second side of the substrate at the transparent portion and adapted to replicate and form a micro-optical structure in the optical medium on the second side of the substrate, the opaque portion of the substrate remaining uncovered by the layer of material acting as an optical medium and the in-line casting device being located in a conveying path for the substrate between the feeding device and the delivery unit;

at least one drying/curing unit configured to dry or cure the layer of material acting as the optical medium following replication of the micro-optical structure in the layer of material acting as the optical medium, the at least one drying/curing unit being located to dry or cure the layer of material acting as the optical medium from the second side of the substrate;

a printing unit configured to print on at least the first side of the substrate, the printing unit being located in the conveying path for the substrate between the feeding device and the delivery unit and comprising:

a first printing group comprising a printing cylinder, the first printing group being adapted to print at least one printed pattern directly on the first side of the substrate in register with the micro-optical structure;

a transfer mechanism configured to transfer the substrate from the in-line casting device to the printing unit, the transfer mechanism comprising a first transfer cylinder downstream of the in-line casting device, the transfer mechanism being configured so that the transfer of the substrate between in-line casting device and the printing unit is carried out exclusively from cylinder to cylinder via cooperating cylinder grippers; and a washing device that is configured to be selectively brought into contact with the at least one embossing cylinder during maintenance operations to clean the surface of the at least one embossing cylinder, wherein the first printing group is a collect printing group configured to collect at least two imprints before printing the at least two imprints onto the substrate, wherein the in-line casting device comprises at least one embossing cylinder configured to act as a carrier supporting a replicating medium designed to replicate and form the micro-optical structure in the layer of material acting as the optical medium and/or act as a conveying cylinder carrying and/or supporting the substrate over an angle range, wherein the at least one drying/curing unit is located about a portion of the circumference of the first transfer cylinder located immediately downstream of the at least one embossing cylinder, and wherein the first side of the substrate is opposite the second side of the substrate.

2. The printing press according to claim 1, wherein the first printing group is designed to enable or carry out indirect printing and comprises more than one plate cylinder configured to cooperate with the printing cylinder and more than one associated inking apparatus.

3. The printing press according to claim 1, wherein the in-line casting device comprises at least one application unit configured to apply at least a part of the layer of material acting as the optical medium.

4. The printing press according to claim 3, wherein a screen-printing unit is configured to act as an application unit for applying at least a part of the layer of material acting as the optical medium.

5. The printing press according to claim 1, wherein the in-line casting device further comprises at least one pressure cylinder or roller configured to cooperate with the at least one embossing cylinder to press the substrate against the replicating medium.

6. The printing press according to claim 5, wherein the at least one embossing cylinder is located in the conveying path of the substrate immediately after an application unit.

7. The printing press according to claim 1, wherein the first printing group comprises one or more plate cylinders and one or more associated inking apparatuses designed to enable or carry out offset printing and/or comprises one or more plate cylinders and one or more associated inking apparatuses designed to enable or carry out indirect relief printing.

8. The printing press according to claim 1, wherein the printing cylinder of the first printing group is configured to act as a collecting cylinder to collect ink patterns from a plurality of associated plate cylinders and transfer the resulting multicolour pattern of inks onto the substrate and wherein the printing cylinder of the first printing group is configured to transfer the resulting multicolour pattern of inks onto the first side of the substrate in register with the micro-optical structure.

9. The printing press according to claim 8, wherein the ink patterns collected by the collecting cylinder are of different colours.

10. The printing press according to claim 1, wherein the printing unit comprises a second printing group in the substrate path configured to cooperate with the first printing group in order to build a common nip as a double-sided printing group for a simultaneous recto-verso printing of the substrate.

11. The printing press according to claim 10, wherein the second printing group is designed as a collect printing group configured to collect at least two imprints before being printed onto the substrate and wherein the second printing group comprises at least one cylinder configured to act as a collecting cylinder to collect ink patterns from a plurality of associated plate cylinders and transfer a resulting pattern of inks onto the respective side of the substrate in register with the micro-optical structure and/or with the printing carried out by the first printing group.

12. The printing press according to claim 11, wherein the ink patterns collected by the collecting cylinder are of different colours.

13. The printing press according to claim 1, wherein the printing press comprises a third printing group in the substrate path configured to print the substrate on one side.

14. The printing press according to claim 13, wherein the third printing group in the substrate path is configured to print the substrate on the first side of the substrate.

15. The printing press according to claim 1, wherein the micro-optical structure is configured to be replicated by the in-line casting device upstream of a location where the printed pattern is printed by the first printing group of the printing unit.

16. The printing press according to claim 1, wherein the in-line casting device is adapted to apply the layer of material acting as the optical medium on the portion of the second side of the substrate and to replicate and form the micro-optical structure in the layer of material acting as the optical medium by firstly applying the material acting as the optical medium onto the substrate on the second side and downstream being brought into contact with an embossing tool to form the micro-optical structure.

17. The printing press according to claim 1, wherein the in-line casting device is adapted to apply the layer of material acting as the optical medium on the portion of the second side of the substrate and to replicate and form the micro-optical structure in the layer of material acting as the optical medium by firstly applying the material acting as the optical medium directly onto the lateral surface of an embossing cylinder in an angular segment not yet being covered by the substrate to be applied with the material.

18. The printing press according to claim 1, wherein the security documents are banknotes.

19. The printing press according to claim 1, wherein the at least one drying/curing unit is a UV-curing unit.

20. The printing press according to claim 19, wherein the UV-curing unit is a UV-LED curing unit.

21. The printing press according to claim 1, wherein the drying/curing unit is configured to dry or cure the layer of material acting as the optical medium as the substrate is being transferred between the in-line casting device and the printing unit.

22. The printing press according to claim 21, wherein the drying/curing unit is located downstream of the casting device.

23. The printing press according to claim 1, wherein the transfer mechanism further comprises a second transfer cylinder immediately downstream of the first transfer cylinder, each of the first and second transfer cylinders comprising grippers, and wherein the second transfer cylinder is located upstream of the printing cylinder.

24. The printing press according to claim 23, wherein the first transfer cylinder is positioned to prevent radiation emitted from the at least one drying/curing unit from reaching the second transfer cylinder.

25. The printing press according to claim 1, wherein the printing press comprises a transfer cylinder between the in-line casting device and the printing unit, and wherein the drying/curing unit is positioned to dry/cure the layer of material acting as the optical medium when the substrate is being carried by the transfer cylinder.

26. The printing press according to claim 1, wherein the at least one drying/curing unit is positioned to dry or cure the layer of material acting as the optical medium only when the substrate is positioned on the first transfer cylinder.

27. The printing press according to claim 1, wherein the washing device is configured to clean the replicating medium after the substrate has been transferred to the first transfer cylinder.

* * * * *